United States Patent [19]

Hafer et al.

[11] Patent Number: 4,828,011

[45] Date of Patent: May 9, 1989

[54] COUNTERGRAVITY CASTING APPARATUS

[75] Inventors: Paul H. Hafer, Rochester Hills; Bradley W. Hanson, Saginaw; Jeffrey D. Porter, Saginaw; James Smith, Jr., Saginaw, all of Mich.

[73] Assignee: General Motors Corporation, Detroit, Mich.

[21] Appl. No.: 211,020

[22] Filed: Jun. 24, 1988

[51] Int. Cl.[4] ..... B22D 18/06

[52] U.S. Cl. ..... 164/255; 164/306

[58] Field of Search ..... 164/119, 255, 63, 306, 164/254, 256, 65, 361, 363, 364, 339, 341, 137

[56] References Cited

U.S. PATENT DOCUMENTS

| | | | |
|---|---|---|---|
| 2,379,401 | 6/1945 | Poulter . | |
| 2,845,669 | 8/1958 | Hackett et al. . | |
| 2,923,040 | 2/1960 | Goodwin et al. . | |
| 3,774,668 | 11/1973 | Iten et al. | 164/255 |
| 4,340,108 | 7/1982 | Chandley et al. | 164/63 |
| 4,508,157 | 4/1985 | Belliveau et al. | 164/63 |
| 4,632,171 | 12/1986 | Almond | 164/255 |
| 4,658,880 | 4/1987 | Voss | 164/255 |

*Primary Examiner*—Kuang Y. Lin

*Attorney, Agent, or Firm*—Lawrence B. Plant

[57] ABSTRACT

Immersion-type vacuum countergravity casting apparatus having a vacuum chamber including spring means for pressing the mold portions sealingly together and/or resisting destructive inward flexure of the mold. A split vacuum chamber, including a floating lower skirt portion, avoids the creation of stress concentration sites between the chamber and the mold.

17 Claims, 4 Drawing Sheets

COUNTERGRAVITY CASTING APPARATUS

This invention relates to apparatus for the vacuum, countergravity casting of metal in gas-permeable, shell-type molds immersed in a pot of molten metal and, more particularly, to means for mounting the mold to the vacuum chamber so as to: eliminate the need to adhesively bond the mold portions (i.e., cope, drag, cheeks, etc.) together; resist destructive flexure of the mold during the application of the casting vacuum; and/or eliminate stress concentration sites and provide a substantially uniform seal between the mold and the vacuum chamber.

BACKGROUND OF THE INVENTION

The mold-immersion-type, vacuum, countergravity, shell mold casting process is particularly useful in the making of thin-walled, near-net-shape castings and involves: sealing a bottom-gated mold, having a gas-permeable upper portion, to the mouth of a vacuum chamber such that the chamber confronts the upper portion; immersing the underside of the mold in an underlying melt; and evacuating the chamber to draw melt up into the mold through one or more of the gates in the underside thereof. Such a process is shown in U.S. Pat. No. 4,340,108 wherein the mold comprises a resin-bonded-sand shell having an upper cope portion and a lower drag portion sealingly mounted to the mouth of the vacuum chamber by means of spring clips. U.S. Pat. No. 4,340,108 seals the mold to the vacuum chamber atop the cope such that the parting line between the mold halves lies outside the vacuum chamber. U.S. Pat. No. 4,632,171 seals the mold to the mouth of the vacuum chamber atop the drag such that the parting line between the cope and drag falls within the vacuum chamber. U.S. Pat. No. 4,658,880 mounts the mold to the vacuum chamber by means of a plurality of reciprocable and rotatable shafts having self-tapping threads on the lower ends thereof engaging mounting sites atop the mold. Chandley, G. D. Automatic Countergravity Casting of Shell Molds, Modern Casting, October 1983, pages 29–31, mounts round molds to a round vacuum chamber having self-tapping threads which screw into the periphery of the mold. U.S. patent application Ser. No. 147,863, filed Jan. 25, 1988 and assigned to the assignee of the present invention, mounts the mold to the vacuum chamber via a plurality of T-bar keepers engaging anchoring cavities in the mold.

The aforesaid references all disclose rigid vacuum boxes and molds whose upper and lower halves are glued together. The gluing process is expensive and time consuming and elimination thereof would improve the efficiency and economics of the process. Moreover, when the aforesaid mold-chamber arrangements are used with molds having more than about 400 square inches of mold confronting the vacuum chamber, there is a tendency for the molds to bow or flex into the chamber when the casting vacuum is drawn therein unless they are made extra strong/thick. This flexure can destroy the mold either by cracking or fracturing the mold or occasionally causing implosion thereof into the chamber.

Two techniques for eliminating gluing the mold portions together and reducing undesirable inward flexure of the mold are the subject of copending U.S. patent applications Ser. Nos. 211,024 and 211,023 filed concurrently herewith and assigned to the assignee of this application. These techniques provide substantially rigid means for pressing the mold portions together and resisting inward flexure of the mold. Such structures, however, do not accommodate process variations well. Hence variations in mold dimensions or untrue mating of the mold with the vacuum chamber can result in improper engagement between the mold and vacuum chamber and/or the creation of stress concentration sites which can cause cracking/fracture of the mold. Moreover, on an automated basis systems such as described in U.S. Ser. No. 211,023 require additional means for locating the pressers and controlling the amount of force applied thereby to prevent damage to the molds or dislodgment thereof from the mouth of the vacuum chamber. It would be desirable to eliminate such extraneous locating and control means and otherwise provide apparatus more tolerant of process variations.

It is the principal object of the present invention to provide an improved simple, self-adjusting apparatus for the vacuum, countergravity casting of unglued shell mold portions including means for resiliently biasing the upper mold portion into sealing engagement with the lower mold portion, resisting destructive flexure of the mold during casting and avoiding the creation of stress concentration sites in the assembly. This and other objects and advantages of the present invention will become more readily apparent from the detailed description thereof which follows.

BRIEF DESCRIPTION OF THE INVENTION

The present invention contemplates mold-immersion-type countergravity casting apparatus of the type described above including spring means resiliently pressing the mold portions (i.e., cope, drag, cheeks) sealingly together (i.e., sans adhesive). When large area molds are used, the spring means functions to resist destructive inward flexure of the molds when the casting vacuum is drawn in the vacuum chamber, which function is served whether the mold parts are glued or not. More specifically, apparatus in accordance with the present invention includes: a mold which is adapted for immersion into an underlying pot of molten metal and which comprises a porous, gas-permeable, upper shell and a bottom-gated lower portion; a vacuum box defining a vacuum chamber confronting the upper shell for evacuating the mold through the shell, which box comprises (1) a ceiling overlying the mold, and (2) a skirt depending from the ceiling and surrounding the shell, which skirt has a peripheral edge on the underside thereof sealingly engaging the mold; means for mounting the mold in the mouth of the vacuum chamber; and spring means resiliently pressing the shell into sealing engagement with the lower mold portion and/or resisting destructive inward flexure of the mold when a vacuum is drawn in the vacuum box. The spring means provides the vacuum box with self adjustability to compensate for process variations (e.g., variations in mold dimensions from one to the next) and will preferably be secured to a removable plate affixed to the inside of the chamber to minimize the number of possible vacuum leak sites.

The vacuum box will preferably include a two-part skirt, i.e., a skirt which is horizontally split into an upper fixed portion carried by the mold/chamber transfer mechanism and a self-truing, lower, floating portion. The upper and lower skirt portions are separated one from the other by a narrow (e.g., about 5/16 inch) gap which permits to and fro movement of the upper and lower portions relative to each other. Spring-containing retainers couple the upper and lower skirt portions together and serve to press the mold-sealing edge of the lower skirt portion down onto the mold so as to eliminate the creation of stress concentration sites (i.e., high pressure points) and provide a substantially even-/uniform pressure on the peripheral seal between the mold and lower skirt.

DETAILED DESCRIPTION OF SPECIFIC EMBODIMENTS

The invention may better be understood when considered in the light of the following detailed description of certain specific embodiments thereof which is given hereafter in conjunction with the several drawings in which.

Figure 1:
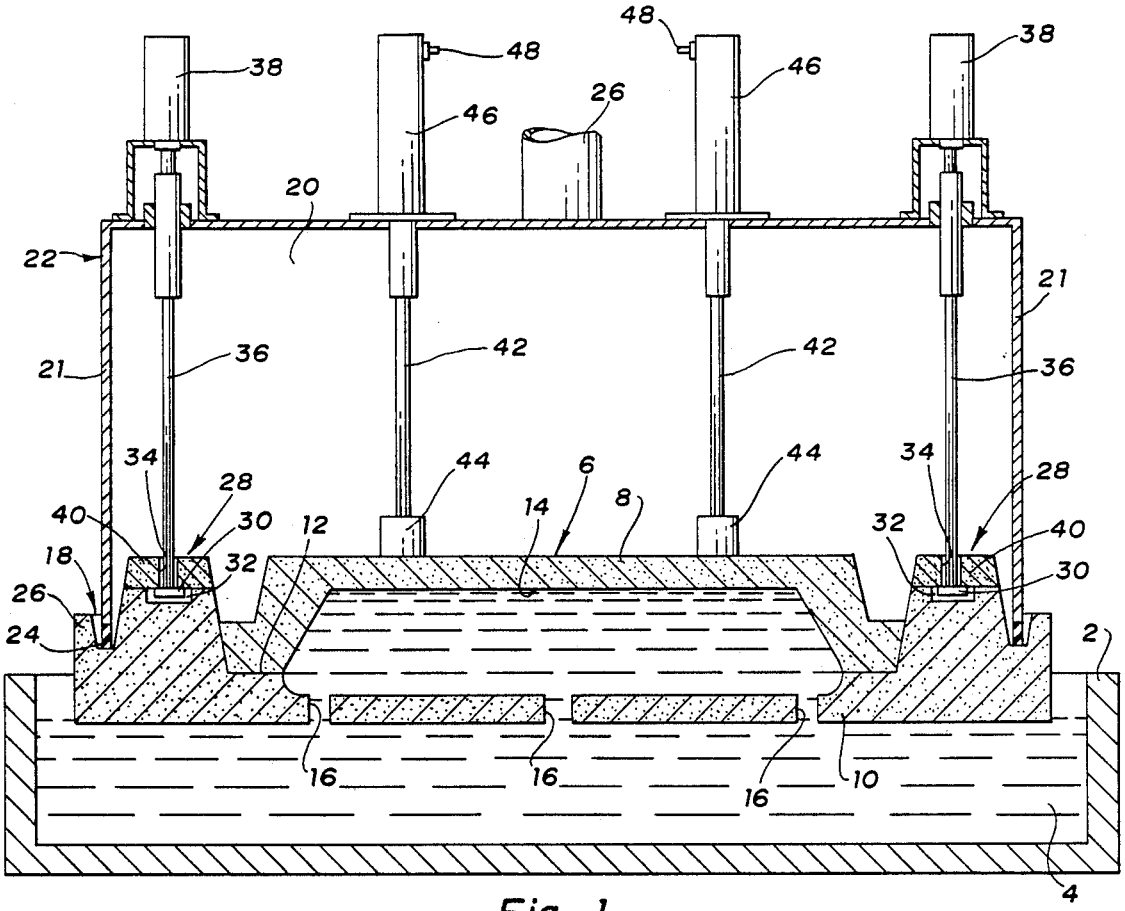
FIG. 1 is a partially sectioned, elevational view of one embodiment of a countergravity casting apparatus according to the present invention.

FIG. 1 depicts a pot 2 of metal melt 4 which is to be drawn up into a mold 6 comprising a gas-permeable upper shell portion 8 and a lower portion 10 joined at a parting line 12 and defining a molding cavity 14 therebetween. The lower portion 10 includes a plurality of ingates 16 in the underside thereof for admitting melt 4 to the mold cavity 14 when it is evacuated through the shell 8. The lower portion 10 of the mold 6 is sealed to the mouth 18 of a vacuum chamber 20 (i.e., defined by vacuum box 22) via a compressible seal 24 (e.g., high temperature rubber, ceramic rope, etc.) affixed to the lower peripheral edge of the depending skirt 21 of the box 22. The vacuum chamber 20 encompasses the upper portion 8 of the mold 6 and communicates with a vacuum source (not shown) via conduit 26. The upper portion 8 of the mold 6 comprises a gas-permeable material (e.g., resin-bonded sand, ceramic, etc.) which permits gases to be withdrawn from the casting cavity 14 therethrough when a vacuum is drawn in the chamber 20. The lower mold portion 10 of the mold 6 may conveniently comprise the same material as the upper mold portion 8 or other materials, permeable or impermeable, which are compatible with the upper portion material. The lower mold portion 10 includes an upstanding levee 26 surrounding the seal 24 and isolating it from the melt 4 as described in copending U.S. patent application Ser. No. 077,891, filed July 27, 1987 and assigned to the assignee of the present invention.

The lower mold portion 10 includes a plurality of anchoring sites 28 engaged by T-bar keepers 30 of the type described in the aforesaid U.S. patent application U.S. Ser. No. 147,863 which is incorporated herein by reference as it relates to such means for mounting the mold 6 to the vacuum box 22. As described in that application, the lower portion 10 of the mold 6 includes a plurality of anchoring cavities 32 adapted to receive T-bar keepers 30 via slots 34 in the shelves 40 overlying the anchoring cavity 32. A 90° rotation of the T-bar carrying shafts 36 (e.g., by air motors 38) cause the T-bar keepers 30 to engage the underside of the shelves 40 overhanging the cavities 30 to secure the mold to the box 22. Other mounting means such as disclosed in the other references (supra) would, of course, also be acceptable.

The upper shell portion 8 is pressed into sealing engagement with the lower mold portion 10 (i.e., at the parting line 12) by means of a plurality of plungers 42. Feet 44 on the ends of the plungers 42 distribute the force of the plungers 42 more widely across the top of the shell 8 to prevent penetration/puncture thereof by the ends of the plungers 42. Pneumatic springs 46 bias the plungers 42 downwardly to resiliently press the shell portion 8 against the lower mold portion 10 as the mold 6 is being positioned in the mouth 18 of the box 22. Schrader valves 48 on the air springs 46 permit varying the pressure in the springs 46 as needed to apply sufficient force to press the upper portion 8 into sealing engagement with the lower portion 10, and, as needed, to prevent destructive inward flexure of the mold 6 when the casting vacuum is drawn. The force applied by the plungers 42, however, will not be so great as to overpower and damage the anchoring sites 28, dislodge the mold 6 from the mouth 18 of the box 22, or break the seal formed thereat.

Figure 2:
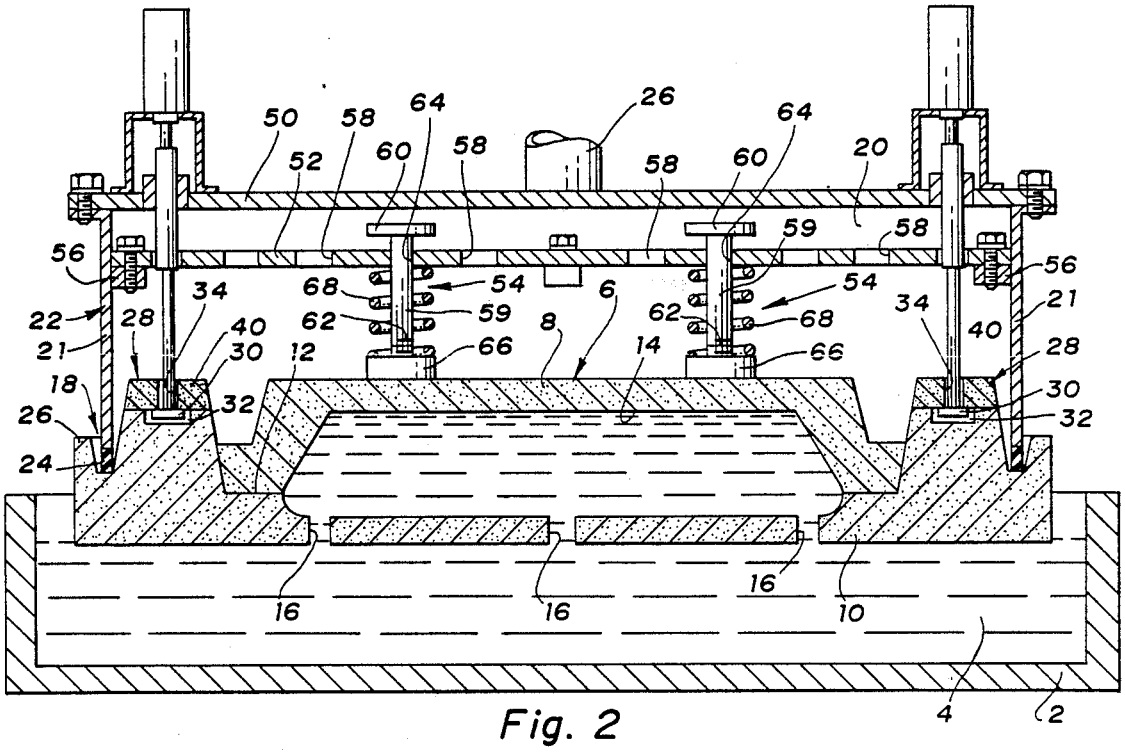
FIG. 2 is a partially sectioned elevational view of another embodiment of a countergravity casting apparatus according to the present invention.

In accordance with another embodiment of the present invention, FIG. 2 depicts a countergravity casting apparatus similar to that of FIG. 1 but differing therefrom with respect to the nature of the spring means used to press the upper shell 8 against the lower mold portion 10. The structural elements of the apparatus of FIG. 2 which are common to the structural elements of the apparatus of FIG. 1 have the same numerical designation. The apparatus of FIG. 2 differs from that of FIG. 1 in that the vacuum box 22 has a removable ceiling 50 which permits ready changeover from one size vacuum box to the next by merely bolting on differently dimensioned skirts 21. Moreover, the separable ceiling 50 provides topside access to the vacuum chamber 20 for removal of carrier plate 52 used to support and carry the spring means 54 totally within the confines of the box 22. More specifically, the carrier plate 52 is bolted at ears 56 welded to the inside of the skirt 21 of the box 22. The plate 52 may include apertures 58, as necessary, to insure that the entire chamber 20, on both sides of the plate 52, is maintained at substantially the same subatmospheric pressure during casting and to permit gasses generated during the molding to exhaust from the chamber 20 via the conduit 26. In this embodiment, the spring means 54 comprises a shaft 59 within a coil spring 68 and having a head 60 on the upper end thereof and external threads 62 on the lower end thereof. The shaft 59 slides through an opening 64 in the plate 52 with the head 60 serving as a stop to prevent the shaft 59 from falling or being pushed out of the opening 64. A foot 66 having internal threads (not shown) is screwed onto the threads 62 and may be used to fine tune the length of the shaft 59 and force exerted by the coil spring 68 compressed between the foot 66 and the underside of the plate 52 as shown.

Before the mold 6 is assembled to the box 22, the spring means 54 will hang from the plate 52 by engagement of the head 60 therewith. When the mold 6 is positioned in the mouth 18 of the box 22, the upper portion 8 pushes up on the lower end of the spring means 54 (i.e., collar 66) causing compression of the coil springs 68 and upward unseating of the head 60 from the top of the plate 52. In this position, the compressed springs 68 push back on the upper mold member 8 with sufficient force to cause it to seat and seal atop the lower mold member 10 and to resist the tendency of the mold 6 to flex or bow inwardly when a vacuum is drawn in the chamber 20. The force supplied by the spring 68 will, however, not be so great as to break the mounting sites 28, disrupt the seal formed at the mouth 18 of the box 22 or otherwise dislodge the mold 6 from the box 22.

Figure 3:
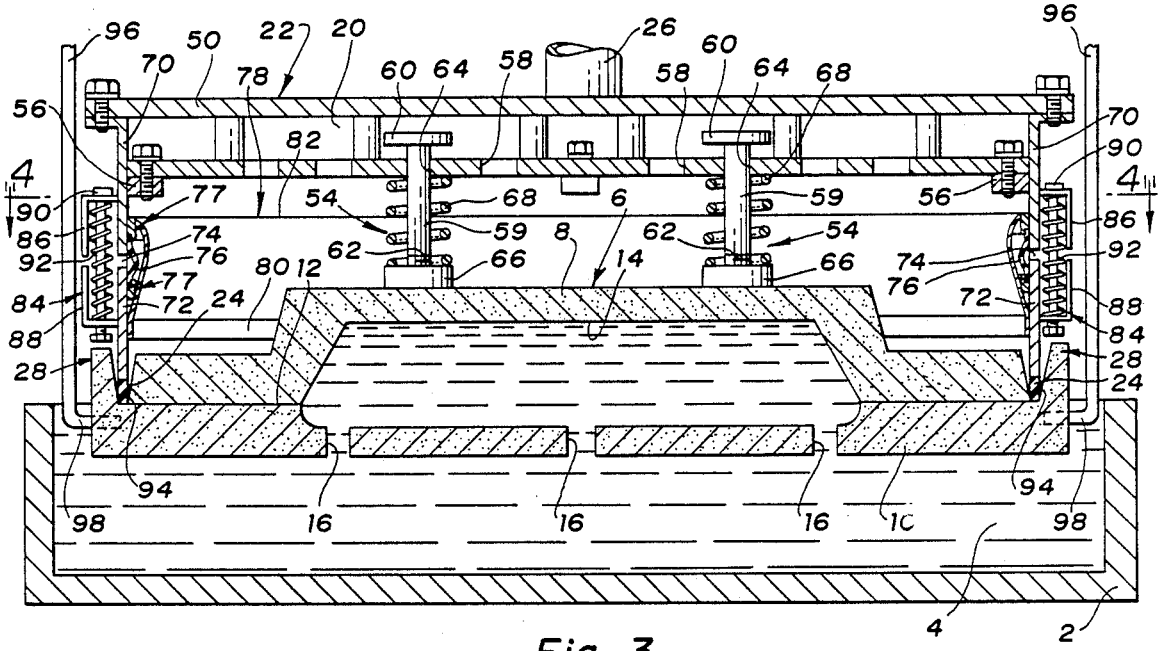
FIG. 3 is a partially sectioned elevational view of still another embodiment of a countergravity casting apparatus according to the present invention.
Figure 4:
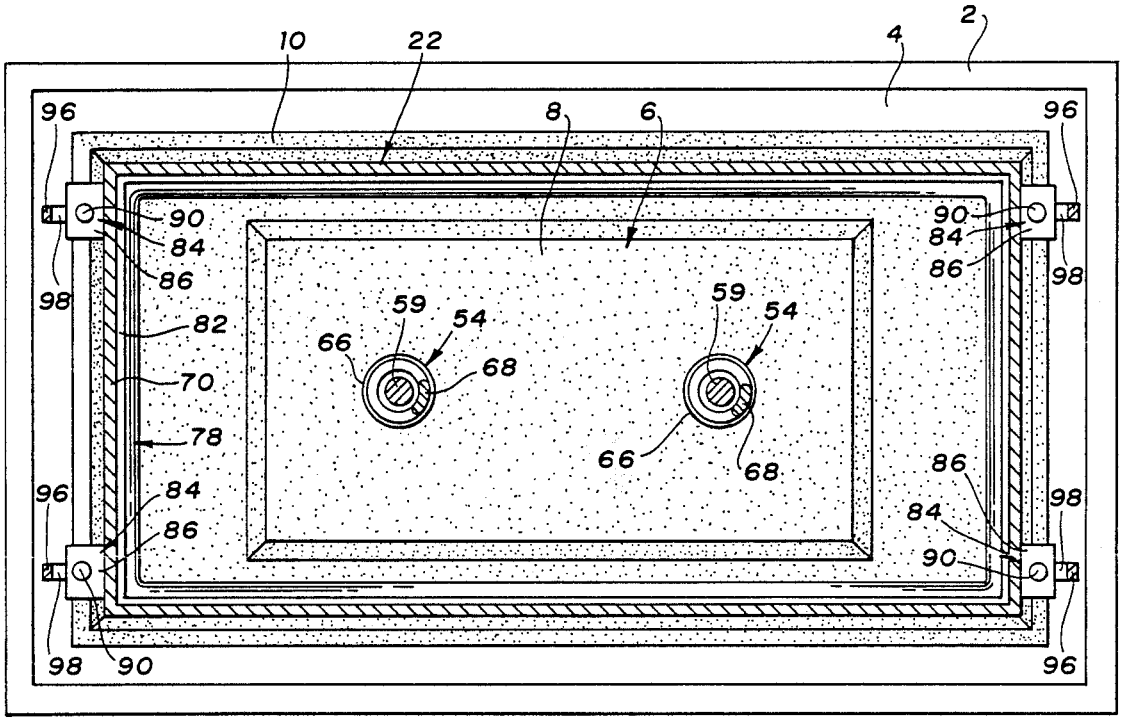
FIG. 4 is a view in the direction 4–4 of FIG. 3.
Figure 7:
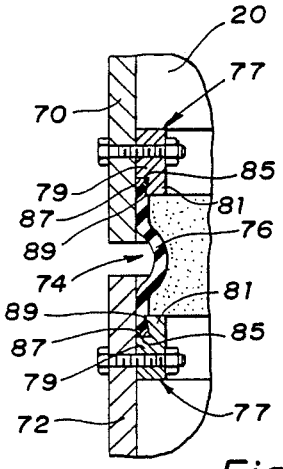
FIG. 7 is an enlargement of a portion of the vacuum chamber of FIG. 3.
Figure 8:
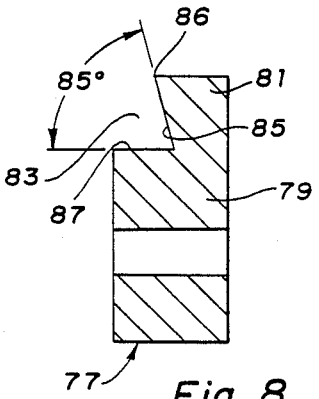
FIG. 8 is an enlargement of the seal clamping bar of FIG. 7.

The embodiments shown in FIGS. 3 and 4 are similar to that shown in FIG. 2 but contain additional features described hereafter relating to another important and preferred feature of the invention. More specifically, the skirt depending from the ceiling 50 of the vacuum box 22 is horizontally separated into an upper skirt portion 70 and a lower skirt portion 72 separated one from the other by a gap 74. The gap 74 will typically be about 5/16 inch wide. As best shown in FIG. 7, a two inch wide flexible sealing member 76 coextensive with the gap 74 is secured to the upper and lower skirt portions 70 and 72, respectively, so as to cover the gap 74 and thereby maintain the integrity of the vacuum chamber 20 when the vacuum is drawn therein yet permit the lower skirt portion 72 to float sufficiently to level or true itself with respect to the mold 6 even when the horizontal plane of the mold is not perfectly parallel to the sealing edge of the vacuum box 22. The flexible seal 76 comprises a 0.60 inch thick gas impermeable Fiberglas-filled silicone rubber material commonly used for conveyor belts and provided by the F. B. Wright Co. as Material No. GP 207-100-MC-2-108. This seal material was found to be particularly effective in resisting inward ballooning and rupturing when the vacuum is drawn in the chamber yet still be flexible enough for the intended purpose. The seal 76 is attached to the upper and lower skirt portions 70 and 72, respectively, by a pair of continuous bar clamps 77 bolted to the upper and lower skirt portions at a plurality of locations. As best shown in FIG. 8, the bar clamps 77 each include a base portion 79 for bolting to the skirt and a leg portion 81 extending from the base portion 79 to define a continuous recess 83 therebetween for engaging and pressing the seal 76 tightly against the inside wall of the skirt. The inside face 85 of the leg 81 lies at an acute angle (preferably about 85°) to the face 87 of the base 79 to provide a sharp edge 89 which bites into the seal 76 to firmly hold the seal 76 in place. A sheet metal shield 78 is secured along its bottom edge 80 to the lower skirt portion 72 and extends upwardly and over the seal 76 to protect it from physical and/or thermal damage (e.g., metal spatter). The upper edge 82 of the shield 78 is unattached and is free to slide along the inside surface of the upper skirt portion 70 as the gap 74 opens and closes in the manner described hereinafter.

The upper and lower skirt portions 70 and 72, respectively, are held together by a retaining means 84 which permits the lower portion 72 to float somewhat independently of the upper portion yet prevents it from so separating from the upper portion 70 as to damage the seal 76. More specifically, the retainer means 84 includes an upper bracket 86 secured (e.g., welded) to the upper skirt member 70 and a lower bracket 88 welded to the lower skirt portion 72. A bolt 90 extends loosely through the brackets 86 and 88 so as to permit relative movement between the bolt and the brackets. A coil compression spring 92 surrounds the bolt 90. The combination of the gap 74, retainer means 84 and flexible seal 76 permits the lower skirt portion 72 to float relative to the upper skirt portions 70 to better receive the mold 6 without damaging it such as could occur if pressure points or stress sites were otherwise created. The springs 92 press the lower skirt portion 72 down against the sealing surface 94 atop the lower mold portion 10 so as to provide a substantially uniform sealing pressure therebetween regardless of any unlevel or unplumb condition existing between the mold 6 and the box 22.

In the embodiment shown in FIGS. 3 and 4, the mold 6 is supported on hangers 96 having L-shaped hooks 98 which carry the mold 6 from a loading station to the casting station shown in FIG. 3. In operation, the mold 6 is first placed on the hangers 96 (i.e., at the loading station) and the vacuum box 22 lowered to engage a stop located such that the lower skirt portion 72 touches/engages the mold 6 with substantially no compression of the springs 68 or 90. The thusly mated mold 6 and box 22 are then transferred to the casting station and immersed in the melt 4. At that time, the buoyant forces of the melt cause the mold 6 to float off of the hooks 98, narrow the gap 74, and compress the springs 68 and 90 until equilibrium is established. Finally, when the vacuum is drawn in the chamber 20, the mold 6 is drawn further off the hooks 98 and up into the box 22 further closing the gap 74 and compressing the springs 68 and 90. The unique features of this, the preferred embodiment of Applicant's invention, provide a self-adjusting system which accommodates wide process variations without stressing the molds to the point of breakage.

Figure 5:
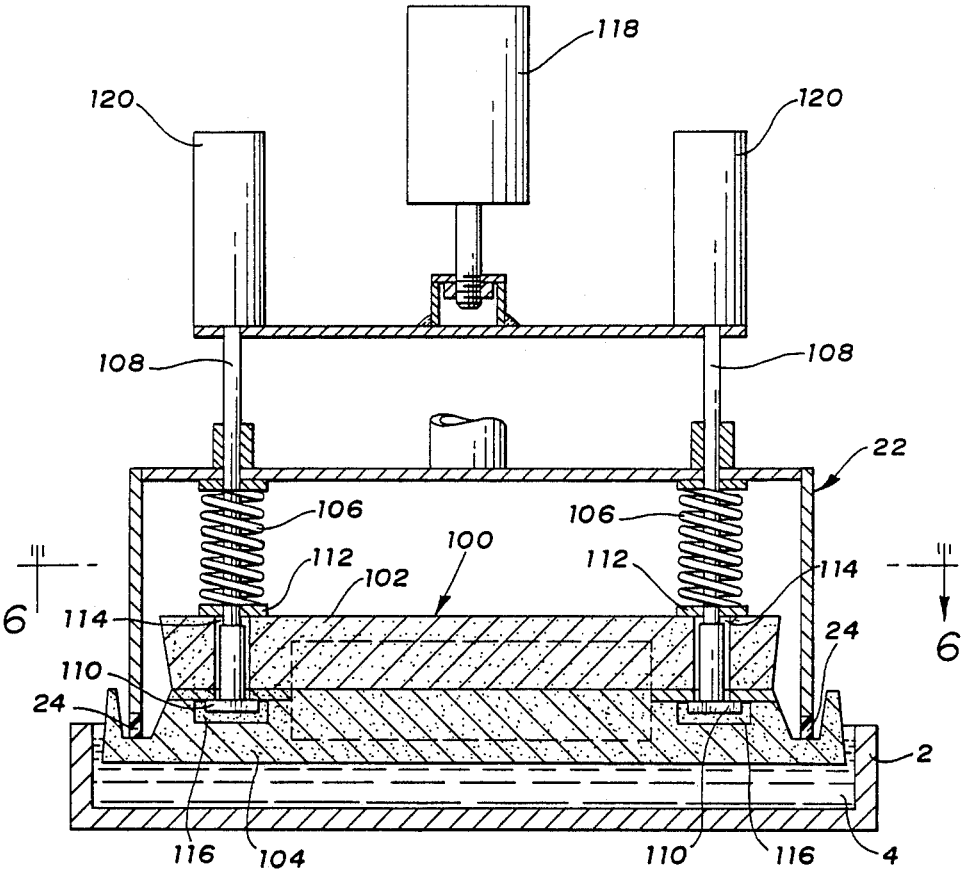
FIG. 5 is a partially sectioned elevational view of still another embodiment of a countergravity casting apparatus according to the present invention.
Figure 6:
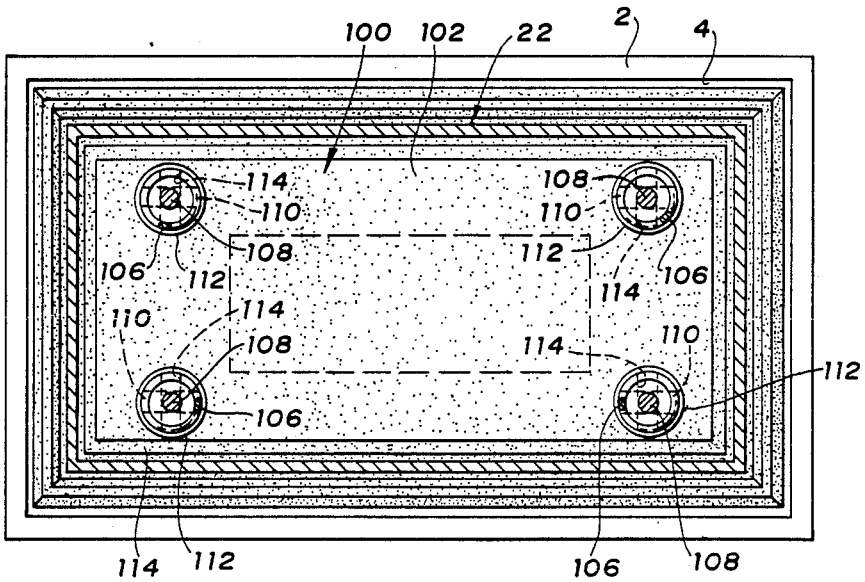
FIG. 6 is a view in the direction 6–6 of FIG. 5.

FIGS. 5 and 6 depict still another embodiment of Applicant's invention and, more specifically, show a mold 100 having an upper portion 102 resiliently pressed against a lower portion 104 by means of coil springs 106 surrounding the shaft 108 used to carry the T-bar keepers 110. In this regard, a washer 112 adapted to slide axially along the shaft 108 engages the top surface of the upper portion 102 surrounding the slot 114 in the upper portion 102 through which the T-bar keepers 110 passes to access the anchoring cavity 116 formed in the lower mold portion 104. In operation (i.e., at the loading station) the vacuum box 22 descends upon the mold 100 until the seals 24 sealingly engage the upper surface of the lower mold portion 104. Thereafter, an air cylinder 118 lowers the T-bar locking mechanism through the slots 114 until the T-bar keepers 110 are fully within the anchoring cavities 116. At that time, air motors 120 rotate the T-bar keepers to secure the mold in the manner described in U.S. Ser. No. 147,863 supra. At the same time, the upper surface of the upper mold portion 102 engages the washer 112 forcing it upwardly along the shaft 108 and compressing the springs 106 which resiliently press the upper portion 102 down against the lower mold portion 104.

Figure 9:
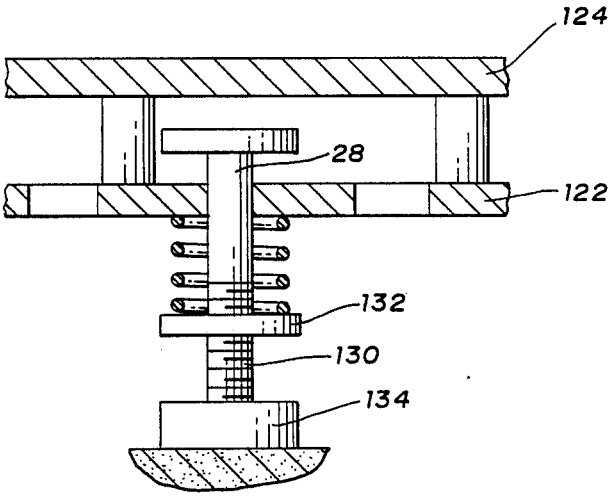
FIG. 9 is a portion of a vacuum chamber like that of FIG. 3 showing a preferred embodiment of the cope biasing spring.

FIG. 9 depicts a preferred embodiment of spring biased plunger pressing the cope to the drag. In this embodiment the spring retainer plate is spaced from the roof of the vacuum chamber by a plurality of spacers 126 and the plunger shaft 128 passes therethrough as described above in conjunction with FIG. 3. In this embodiment, however, the shaft 128 includes longer threads 130 on the lower end thereof for receiving a threaded spring compression adjusting collar 132 as well as a threaded foot 134 so as to provide independent adjustment of the spring compression and the shaft length as may be needed for fine tuning the system.

While the invention has been disclosed primarily in terms of specific embodiments thereof it is not intended to be limited thereto but rather only to the extent set forth hereafter in the claims which follows.

The embodiments of the invention in which an exclusive property or privilege is claimed are defined as follows:

1. Apparatus for the vacuum countergravity casting of molten metal comprising:

a frangible mold comprising a porous gas-permeable upper shell at least in part defining a molding cavity and a lower portion adapted for immersion into a pot of said metal underlying said mold when filling said cavity with said metal and emersion from said pot after said filling said lower portion including at least one gate in the underside thereof for admitting said metal into said cavity upon evacuation of said cavity;

a vacuum box defining a vacuum chamber confronting said upper shell for evacuating said cavity through said shell, said box including a peripheral edge on the underside thereof defining a mouth receiving and sealingly engaging said lower portion;

means for mounting said mold to said mouth with said lower portion in sealing engagement with said edge; and spring means in said chamber for engaging said shell when said mold is positioned in said mouth, pressing said shell into sealing engagement with said lower portion and resisting external force on said mold tending to push said mold into said chamber.

2. Apparatus according to claim 1 wherein said spring means comprises a plunger engaging the top of said shell.

3. Apparatus according to claim 2 wherein said spring means comprises a coil spring surrounding said plunger.

4. Apparatus according to claim 3 including means adjustable along the length of said plunger to adjust the force applied by said spring.

5. Apparatus according to claim 4 wherein said adjusting means comprises a threaded collar engaging threads on said plunger.

6. Apparatus according to claim 1 wherein said spring means comprises a pneumatic spring.

7. Apparatus according to claim 1 including a mounting plate supporting said spring means and secured to said box within said chamber overlying said mold.

8. Apparatus for the vacuum countergravity casting of molten metal comprising:

a mold comprising a porous gas-permeable upper shell at least in part defining a molding cavity and a lower portion adapted for immersion into a pot of said metal underlying said mold, said lower portion including at least one gate in the underside thereof for admitting said metal into said cavity upon evacuation of said cavity;

a vacuum box defining a vacuum chamber confronting said upper shell for evacuating said cavity through said shell, said box comprising a ceiling overlying said mold and a skirt depending from said ceiling and surrounding said shell, said skirt having a first portion engaging said ceiling and a second portion underlying said first portion, said second skirt portion being movably spaced from said first skirt portion by a gap and including a peripheral edge on the underside thereof defining a mouth receiving and sealingly engaging said lower portion;

a substantially gas-impermeable, flexible seal engaging said first and second skirt portions substantially coextensively with said gap to permit relative movement between said first and second skirt portions while maintaining the integrity of said vacuum chamber; and spring means resiliently pressing on said shell during the application of vacuum to said chamber to press said shell into engagement with said lower mold portion with sufficient force to seal said shell and lower mold portion together sans adhesive, prevent destructive flexure of said mold, and permit relative motion between said mold and said upper skirt portion when said mold is immersed in said metal.

9. Apparatus according to claim 8 wherein said flexible seal comprises Fiberglas-filled silicone rubber.

10. Apparatus according to claim 8 including clamping means engaging the longitudinal edges of said flexible seal substantially continuously about said skirt to press said edges securely against said skirt portions on opposite sides of said gap, said clamping means comprising an elongated bar having an elongated recess therein receiving said edges and being defined by walls extending at an acute angle one to the other to provide an elongated pressure ridge portion along one side of said recess for biting into said seal, pressing it tightly against said skirt and trapping said edge in said recess.

11. Apparatus for the vacuum countergravity casting of molten metal comprising:

a mold comprising a porous gas-permeable upper shell at least in part defining a molding cavity and a lower portion adapted for immersion into a pot of said metal underlying said mold, said lower portion including at least one gate in the underside thereof for admitting said metal into said cavity upon evacuation of said cavity;

a vacuum box defining a vacuum chamber confronting said upper shell for evacuating said cavity through said shell, said box comprising a ceiling overlying said mold and a skirt depending from said ceiling and surrounding said shell, said skirt having a first portion engaging said ceiling and a second portion underlying said first portion, said second skirt portion being movably spaced from said first skirt portion by a gap and including a peripheral edge on the underside thereof defining a mouth receiving and sealingly engaging said lower portion;

a substantially gas-impermeable, flexible seal engaging said first and second skirt portions substantially coextensively with said gap to permit relative movement between said first and second skirt portions while maintaining the integrity of said vacuum chamber; and spring means resiliently pressing on said shell for pressing said shell into engagement with said lower portion with sufficient force as to seal said shell and lower portion together sans adhesive and to prevent destructive flexure of said mold upon application of vacuum to said chamber.

12. Apparatus according to claim 11 including clamping means engaging the longitudinal edges of said flexible seal substantially continuously about said skirt to press said edges securely against said skirt portions on opposite sides of said gap, said clamping means comprising an elongated bar having an elongated recess therein receiving said edges and being defined by walls extending at an acute angle one to the other to provide an elongated pressure ridge portion along one side of said recess for biting into said seal, pressing it tightly against said skirt and trapping said edge in said recess.

13. Apparatus according to claim 11 wherein said flexible seal lies inside said chamber and a shield secured to one of said skirt portions overlies said seal to protect said seal from damage.

14. Apparatus according to claim 13 including retainer means coupling said first and said second skirt portions together in substantially aligned relation one to the other across said gap, said retainer means being adapted to permit relative movement between said skirt portions.

15. Apparatus according to claim 14 wherein said retainer means includes means for resiliently pressing said second skirt portion into sealing engagement with said lower mold portion substantially uniformly along said edge.

16. Apparatus according to claim 15 wherein said skirt pressing means comprises a plurality of springs distributed about the periphery of said box.

17. Apparatus for the vacuum countergravity casting of molten metal comprising:

a frangible mold comprising a porous, gas-permeable upper shell at least in part defining a molding cavity, a lower portion sealingly engaging said shell sans adhesive along a parting line therebetween, and at least one gate in the underside of said bottom portion for admitting said metal into said cavity from a pot of said metal underlying said mold;

a vacuum box sealingly mated with said mold at substantially the periphery thereof and defining therewith a vacuum chamber confronting said shell for providing subatmospheric pressure to substantially the entire upper surface of said shell for evacuating said cavity through said shell to move said metal from said pot into said cavity when said lower portion is immersed in said pot; and spring means in said chamber resiliently pressing on said shell for preventing destructive inward flexure of said mold during the evacuation of said chamber.

* * * * *